US008655233B2

(12) United States Patent
Matsuzaki

(10) Patent No.: US 8,655,233 B2
(45) Date of Patent: Feb. 18, 2014

(54) DEVELOPER CONTAINER, DEVELOPING DEVICE AND IMAGE FORMING DEVICE

(75) Inventor: Koichi Matsuzaki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 388 days.

(21) Appl. No.: 13/184,626

(22) Filed: Jul. 18, 2011

(65) Prior Publication Data

US 2012/0020703 A1 Jan. 26, 2012

(30) Foreign Application Priority Data

Jul. 22, 2010 (JP) ..... 2010-165372

(51) Int. Cl.
*G03G 15/08* (2006.01)

(52) U.S. Cl.
USPC ..... 399/258; 399/120; 399/260

(58) Field of Classification Search
USPC ..... 399/258, 260, 262, 120
See application file for complete search history.

(56) References Cited

U.S. PATENT DOCUMENTS

| | | | | |
|---|---|---|---|---|
| 5,853,938 | A * | 12/1998 | Nakazawa et al. | 430/108.6 |
| 2005/0117919 | A1* | 6/2005 | Ito et al. | 399/27 |
| 2009/0238609 | A1* | 9/2009 | Koido | 399/262 |
| 2009/0263165 | A1* | 10/2009 | Ota | 399/262 |

FOREIGN PATENT DOCUMENTS

| | | |
|---|---|---|
| JP | A-H04-365072 | 12/1992 |
| JP | A-2009-175309 | 8/2009 |
| JP | A-2010-128250 | 6/2010 |

* cited by examiner

*Primary Examiner* — Walter L Lindsay, Jr.
*Assistant Examiner* — Rodney Bonnette
(74) *Attorney, Agent, or Firm* — Muncy, Geissler, Olds & Lowe, PLLC

(57) ABSTRACT

A developer container includes: an outer case; an ejection opening that is rectangular and formed on the outer case and extends longitudinally along an axial direction of the outer case, and from which a developer is ejected by a weight of the developer. A toner ejection index that is calculated from S/μdM is equal to or more than 0.79, where μ is a degree of agglomeration of the developer, d is a compact density, M is a fill amount of the developer and S is the area of the ejection opening.

16 Claims, 8 Drawing Sheets

| Samples | TC | Angle θ [°] | Length | | Area S [$mm^2$] | Toner | Deg. of Agglomeration μ [%] | Compact Density d [$g/mm^3$] | Fill Amount M [g] | S/μdM | Toner Remaining Amount Evaluation Results |
|---|---|---|---|---|---|---|---|---|---|---|---|
| | | | L1 [mm] | L2 [mm] | | | | | | | |
| Sample 1 | α | 13.1 | 150 | 4 | 600 | A | 16.7 | 0.651 | 80 | 0.69 | × |
| Sample 2 | β | 26.5 | 150 | 8 | 1200 | A | 16.7 | 0.651 | 80 | 1.38 | ○ |
| Sample 3 | | | | | | B | 33.2 | 0.640 | 80 | 0.71 | × |
| Sample 4 | | | | | | C | 51.7 | 0.636 | 80 | 0.46 | × |
| Sample 5 | γ | 36.7 | 190 | 11 | 2090 | A | 16.7 | 0.651 | 80 | 2.40 | ○ |
| Sample 6 | | | | | | | | | 160 | 1.20 | ○ |
| Sample 7 | | | | | | | | | 245 | 0.78 | × |
| Sample 8 | | | | | | B | 33.2 | 0.640 | 80 | 1.23 | ○ |
| Sample 9 | | | | | | | | | 160 | 0.61 | × |
| Sample 10 | | | | | | C | 51.7 | 0.636 | 80 | 0.79 | ○ |
| Sample 11 | | | | | | | | | 160 | 0.40 | × |
| Sample 12 | δ | 72.0 | 180 | 21 | 3744 | A | 16.7 | 0.651 | 245 | 1.41 | ○ |
| Sample 13 | | | | | | B | 33.2 | 0.640 | 160 | 1.10 | ○ |
| Sample 14 | | | | | | C | 51.7 | 0.636 | 160 | 0.71 | × |

Fig. 6

| Samples | TC | Angle θ [°] | Length | | Area S [$mm^2$] | Toner | Deg. of Agglomeration μ [%] | Compact Density d [$g/mm^3$] | Fill Amount M [g] | S/μdM | Toner Remaining Amount Evaluation Results |
|---|---|---|---|---|---|---|---|---|---|---|---|
| | | | L1 [mm] | L2 [mm] | | | | | | | |
| Sample 15 | α | 13.1 | 150 | 4 | 600 | D | 22.4 | 0.553 | 78 | 0.62 | × |
| Sample 16 | β | 26.5 | 150 | 8 | 1200 | D | 22.4 | 0.553 | 78 | 1.24 | ○ |
| Sample 17 | | | | | | E | 38.0 | 0.520 | 78 | 0.78 | × |
| Sample 18 | | | | | | F | 51.5 | 0.541 | 78 | 0.55 | × |
| Sample 19 | γ | 36.7 | 190 | 11 | 2090 | D | 22.4 | 0.553 | 78 | 2.16 | ○ |
| Sample 20 | | | | | | | | | 170 | 0.99 | ○ |
| Sample 21 | | | | | | | | | 240 | 0.70 | × |
| Sample 22 | | | | | | E | 38.0 | 0.520 | 78 | 1.36 | ○ |
| Sample 23 | | | | | | | | | 170 | 0.62 | × |
| Sample 24 | | | | | | F | 51.5 | 0.541 | 78 | 0.96 | ○ |
| Sample 25 | | | | | | | | | 170 | 0.44 | × |
| Sample 26 | δ | 72.0 | 180 | 21 | 3744 | D | 22.4 | 0.553 | 240 | 1.26 | ○ |
| Sample 27 | | | | | | F | 51.5 | 0.541 | 170 | 0.79 | ○ |
| Sample 28 | | | | | | | | | 240 | 0.56 | × |

Fig. 7

DEVELOPER CONTAINER, DEVELOPING DEVICE AND IMAGE FORMING DEVICE

CROSS REFERENCE TO RELATED APPLICATION

The present application is related to, claims priority from and incorporates by reference Japanese Patent Application No. 2010-165372, filed on Jul. 22, 2010.

TECHNICAL FIELD

This application relates to a developer container, a developing device and an image forming device for an electrographic printer and the like.

BACKGROUND

In general, an electrographic printer forms an image on a sheet by a charging process, an exposure process, a development process, a transfer process and a fusion process. In the charging process, a photo-conductive insulation layer is uniformly charged. In the exposure process, an electrostatic latent image is formed by exposing the photo-conductive insulation layer and by eliminating charges on the exposed parts. In the development process, the electrostatic latent image is visualized by adhering toner containing colorant to the photo-conductive insulation layer. In the transfer process, a toner image, which is the obtained visualized image, is transferred from the photo-conductive insulation layer onto the sheet. In the fusion process, the toner image is fixed onto the sheet by heating, pressing or through other known fusion methods. A developing device that performs the development process includes a development roller and a supply roller that supplies toner to the development roller.

In a conventional toner cartridge that supplies toner to the developing device, an agitation member is provided inside a cylindrical shutter part that opens and closes a lower ejection opening formed on a cylindrical part of an external cylinder member. The whole agitation member is rotated while the center of a shaft part of the agitation member over the cylindrical part is changed in order to reduce the remaining amount of the toner that remains unused in the toner cartridge (e.g., see Japanese Laid-Open Patent Application No. 2009-175309 (especially, paragraphs 0027-0029 and 0048, and FIGS. 9 and 13)).

However with a conventional toner cartridge, if the agitation member is removed, it is relatively difficult to smoothly supply toner from the toner cartridge to the developing device.

At least one objective of the embodiment disclosed and claimed in the present application, therefore, is to smoothly supply developer from a developer container (e.g., toner cartridge) to a developing device.

SUMMARY

One embodiment described herein is a developer container that includes an outer case and an ejection opening. The ejection opening is rectangular and formed on the outer case and extends longitudinally along an axial direction of the outer case Developer is ejected from the outer case by a weight of the developer. A toner ejection index is calculated from S/μdM that is equal to or more than 0.79, where μ is a degree of agglomeration of the developer, d is a compact density, M is a fill amount of the developer and S is the area of the ejection opening. A developing device that includes the inventive developer container and an image forming device that includes the developing device with the inventive developer container are also described herein.

Therefore, according to embodiments disclosed and claimed in the present application, it is possible to smoothly supply the developer from the developer container to the developing device.

BRIEF DESCRIPTION OF THE DRAWINGS

FIG. 6 is a table of evaluation results of continuous print tests, using toners produced by a polymerization method, using a developing device according to the exemplary embodiment.

FIG. 7 is a table of evaluation results of continuous print tests, using toners produced by a crushing method, using a developing device according to the exemplary embodiment.

DETAILED DESCRIPTION OF EMBODIMENTS

A development container according to an exemplary embodiment is explained below with reference to the drawings.

Figure 1:
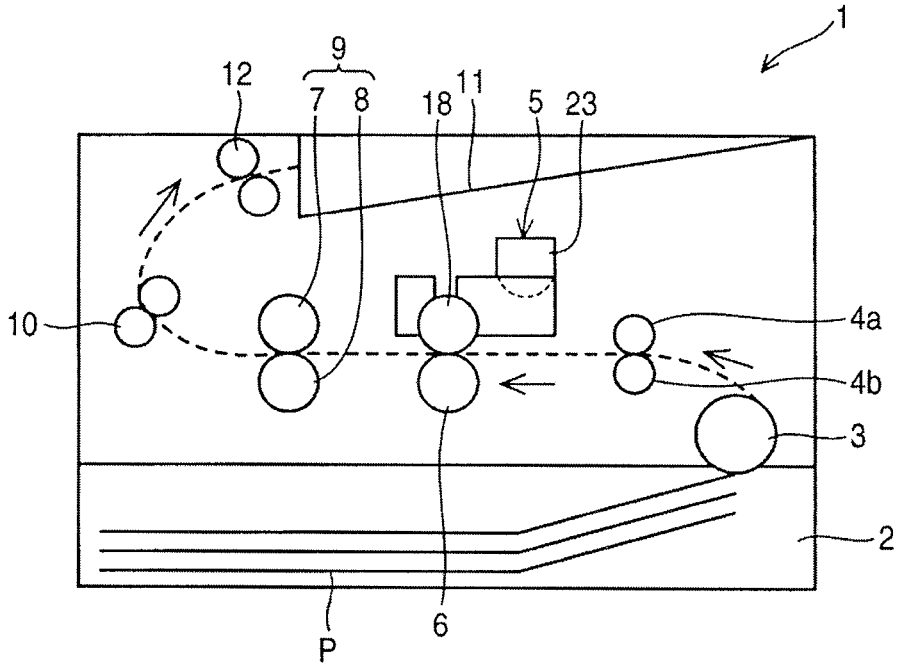
FIG. 1 is a schematic diagram illustrating a printer that includes a developing device according to an exemplary embodiment.

Referring now to FIG. 1, an electrographic printer 1 serves as an image forming device. In the image forming device 1, there are arranged in order, along a carrying path which includes the broken line, a sheet supply cassette 2 that accommodates sheets P as a printing medium, a hopping roller 3 that feeds the sheets P piece by piece from the sheet supply cassette 2, registration rollers 4*a* and 4*b* that carry each sheet P fed by the hopping roller 3 while adjusting the carrying orientation of each sheet P, a developing device 5 that forms a toner image as a developer image to be transferred onto each sheet P, a transfer roller 6 that transfers the toner image formed by the developer device 5 onto the sheet P, a fuser 9 that includes a heat roller 7 and a backup roller 8 that fix the transferred toner image onto each sheet P, carrying rollers 10 that pinch and carry each sheet P along the carrying path indicated by a broken line in FIG. 1, and an ejection roller 12 that ejects each sheet P carried by the carrying rollers 10 onto a stacker 11. The arrows shown in FIG. 1 further indicate the carrying path of the sheet P.

Figure 2:
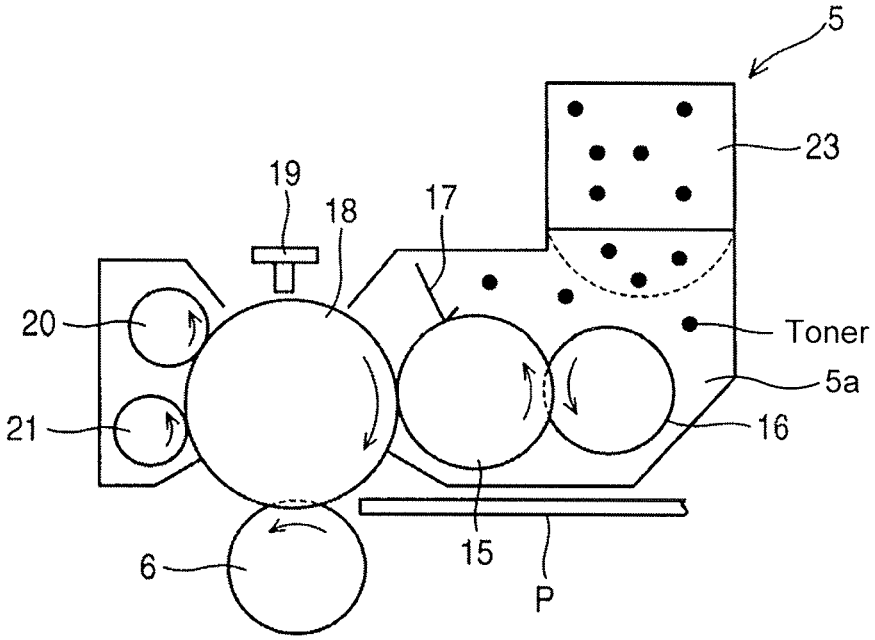
FIG. 2 is a schematic diagram illustrating a developing device according to the exemplary embodiment.

Referring now to FIG. 2, the developing device 5 includes a developing device main body 5*a* and a toner cartridge 23. The developing device main part 5*a* includes a developer carrier (e.g., development roller 15), a developer supply part (e.g., supply roller 16), a thin layer formation member (e.g., developer blade 17), an image carrier (e.g., photosensitive drum 18) that forms an electrostatic latent image on a surface thereof, an exposure part (e.g., light emitting diode (LED) 19) that exposes the photosensitive drum 18 to form the electrostatic latent image thereon, a charging part (e.g., charging roller 20) that charges the photosensitive drum 18, and a residue toner removal part (e.g., cleaning roller 21 or cleaning blade) for removing residue toner on the photosensitive drum 18. The toner cartridge 23 is illustrated as attached to an upper part of the developing device main body 5*a*, but is capable of being detached therefrom.

As illustrated in FIG. 2, toner held in the toner cartridge 23 is ejected into the vicinity of the supply roller 16. This toner is supplied simply due to the weight of toner. Also as illustrated in FIG. 2, the development roller 15, the charging roller 20, and the cleaning roller 21 contact the photosensitive drum 18. Further, the development roller 15 and the supply roller 16 contact each other, and the development blade 17 and the development roller 15 also contact each other. With respect to the photosensitive drum 18, a photosensitive layer made of an organic compound is formed on an aluminum tube. An outer radius of the photosensitive drum 18 may be 29.95 mm, for example.

The development roller 15 includes a core made of steel, a surface of which is plated by nickel, an elastic layer formed by urethane rubber around the core, and a surface layer made of isocyanine formed on an the surface of the elastic layer. An outer diameter of the development roller 15 may be 19.6 mm, for example. The development roller 15 forms a toner image by adhering toner onto the electrostatic latent image formed on the photosensitive drum 18 by the LED head 19.

The supply roller 16 includes silicone foamed rubber around a core. The diameter of cells in the silicone foamed rubber may be in a range of 300-500 μm. An outer diameter of the supply roller 16 may be 15.5 mm, for example, in the center in the axial direction and may be 14.8 mm, for example, at the two ends in the axial direction, for example. The supply roller 16 supplies toner to the development roller 15.

The development blade 17 is made by bending a stainless (SUS304B-TA) plate having a thickness of 0.08 mm, for example. As shown in FIG. 2, the development blade 17 is arranged so that a shorter side of the bent plate faces the upstream side of a rotational direction of the development roller 15, and a longer side faces the downstream side of the rotational direction of the development roller 15. The development blade 17 presses the outer circumferential surface of the development roller 15 so that the development blade 17 is flexed with a certain linear pressure (about 40-70 gf/cm, for example). The development blade 17 forms a thin layer of toner with a predetermined thickness on the surface of the development roller 15.

Although not shown in FIG. 2, a gear for transmitting a drive force is fixed to each roller and drum by pressure insertion or other methods. A gear fixed to the photosensitive drum 18 is called a drum gear. A gear fixed to the development roller 15 is called a development gear. A gear fixed to the supply roller 16 is called a supply gear. A gear fixed to the charging roller 20 is called a charging gear. A gear arranged between the development gear and the supply gear is called an idle gear.

In a conventional toner cartridge, because an agitation member is provided inside the toner cartridge, a drive mechanism and a drive source need to be provided to rotate the agitation member. The structure of the toner cartridge becomes complicated, which is problematic. In addition, if the agitation member in the conventional toner cartridge is removed to simplify the structure of the toner cartridge, it becomes difficult to smoothly supply the toner from the toner cartridge to the developing device.

Figure 3:
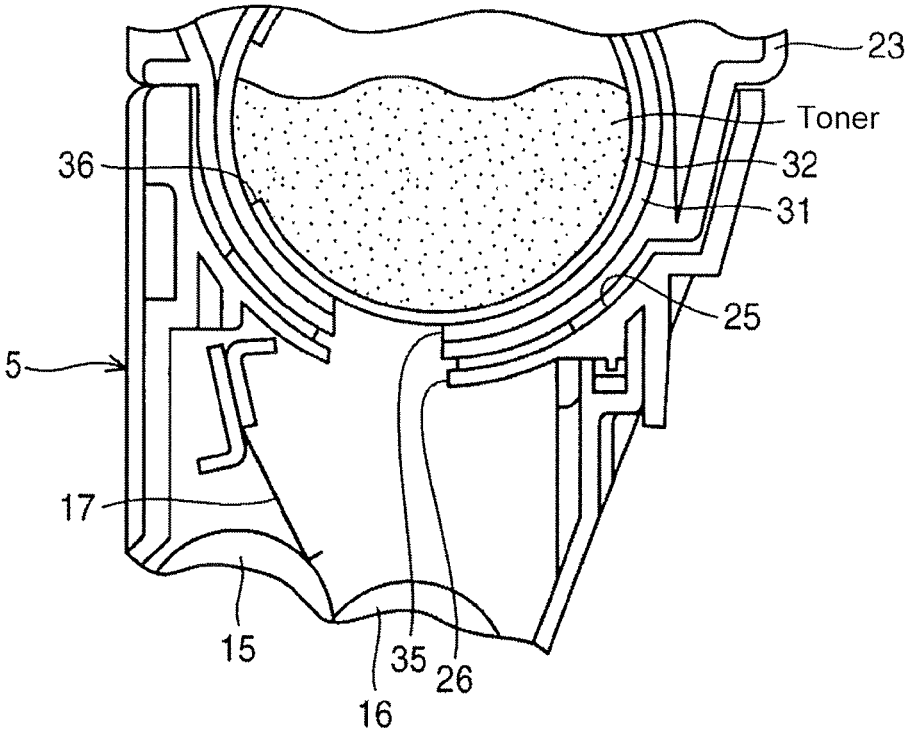
FIG. 3 is a schematic diagram illustrating an installed state of a toner cartridge in a developing device according to the exemplary embodiment.

Referring now to FIG. 3, the toner cartridge 23 is detachably attached to a cartridge installation part 25 formed on the upper part of the developing device 5. A toner supply opening 26 is formed on a bottom part of the cartridge installation part 25, which is curved in a semicircular arc shape. The toner is supplied to the developing device 5 from the toner cartridge 23 through the toner supply opening 26.

Figure 4A:
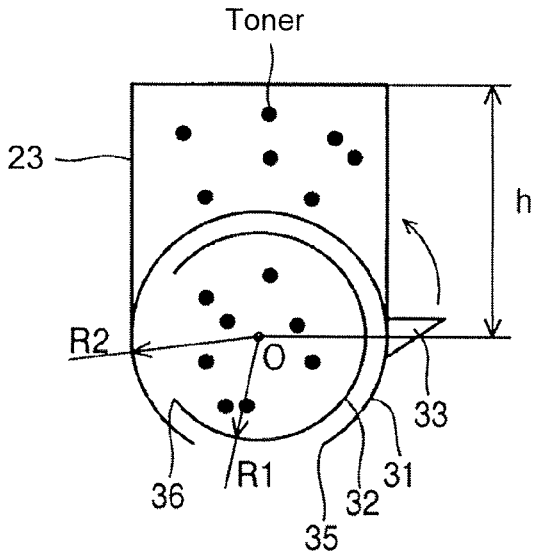
FIGS. 4A and 4B are schematic diagrams illustrating a toner cartridge according to the exemplary embodiment.
Figure 4B:
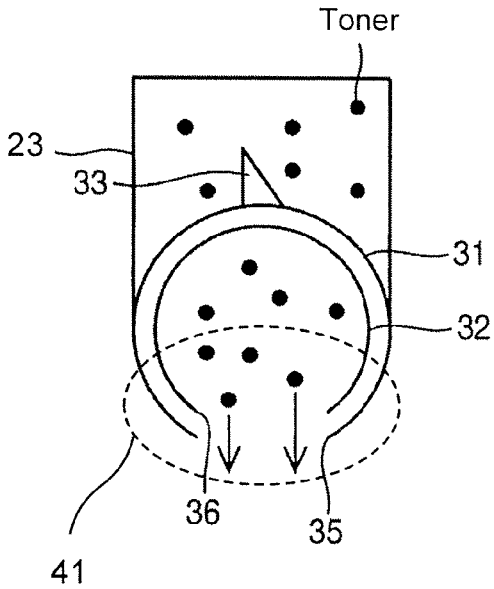

In addition, as shown in FIG. 4B, the toner cartridge 23 has an outer shape, in which a bottom surface of an approximately rectangular parallelepiped is formed with a curvature region 41 including an approximately semicircular arc surface. The curvature region 41 is an arc surface relative to an axial center O illustrated in FIG. 4A. Also shown in FIG. 4A, a cylindrical shutter 32 (or shutter member) concentric with the axial center O is rotatably supported inside an outer case 31 provided at the bottom of the curvature region 41. The shutter 32 rotates together with a lever 33. In the first embodiment, the radius R1 of the outer circumference of the cylindrical part of the shutter 32 is 15.5 mm, for example. The radius R2 of the outer circumference of the outer case 31 is 17.5 mm, for example. The height h from the axial center O of the outer case to the outer side of the rectangular parallelepiped is 65 mm, for example.

As shown in FIG. 3, an ejection opening 35 is formed on the bottom part of the outer case 31 of the toner cartridge 23. It should be noted that the toner cartridge 23 is transported, and sold with, the shutter 32 in a closed state, such that leakage of the toner filled inside the cartridge 23 is prevented, as shown in FIG. 4A. However, when the toner cartridge 23 is installed in the developing device 5, the shutter 32 is rotated to an open state, such that the positions of the opening 36 (or shutter opening) of the shutter 32 and the ejection opening 35 on the bottom part of the outer case 31 are matched. This is performed by rotating the lever 33. As a result, the toner filled inside the toner cartridge 23 is supplied to the developing device 5.

The opening 36 of the shutter 32 and the toner supply opening 26 have sizes equal to or larger than the ejection opening 35. Therefore, the toner in the toner cartridge 23 smoothly moves from the toner cartridge 23 into the developing device 5.

Figure 5A:
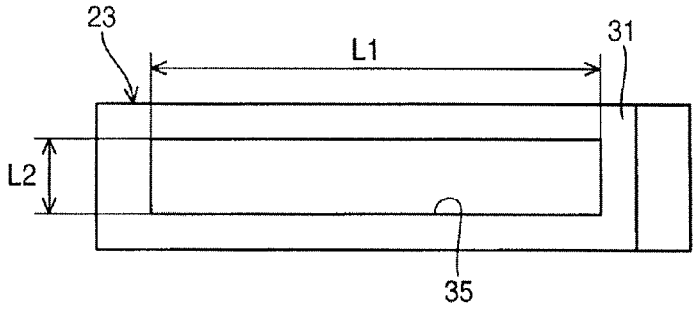
FIGS. 5A and 5B are schematic diagrams illustrating a size of an ejection opening of a toner cartridge according to the exemplary embodiment.

Referring now to FIG. 5A, the ejection opening 35 of the toner cartridge 23 in the present embodiment is formed in a rectangular shape that extends in the axial direction of the outer case 31 as the longitudinal direction, and that is defined by L1 (unit: mm) as the length in the longitudinal side of the ejection opening 35 and L2 (unit: mm) as the length in the lateral side thereof. The printing operation of the printer 1 with the above-described configuration is explained below.

In the printer 1 shown in FIG. 1, when the user transmits image data of an image to be printed to the printer 1 from a host device, such as a personal computer (not shown), a controller (not shown) of the printer 1 that receives the image data initiates rotation of a motor (not shown) in the device main body 5*a*. As a result, the photosensitive drum 18 is rotated as a drive force is transmitted to the drum gear via gears (not shown) provided in the device main body 5*a*. The development roller 15 is rotated as the drive force is transmitted from the drum gear to the development gear. The supply roller 16 is rotated as the drive force is transmitted from the development gear to the supply gear via the idle gear. The charging roller 20 is rotated as the drive force is transmitted from the drum gear to the charging gear.

The rotational direction of each roller in the developing device 5 and the rotational direction of the photosensitive drum 18 in this case are as shown in FIG. 2. At a contact part of the supply roller 16 and the development roller 15, the supply roller 16 and the development roller 15 rotate in directions opposite from each other.

Moreover, by the rotation of the motor in the device main body 5*a*, the drive force is transmitted from the transfer roller 6 and the fuser 9 via gears of another system (not shown) provided in the device main body 5*a*. Further, at the same time as the motor in the device main body 5*a* starts rotating, a predetermined voltage is applied from a power source (not shown) provided in the device main body 5*a*, to each roller in the developing device 5, the photosensitive drum 18, the transfer roller 6, and the heat roller 7 of the fuser 9.

In the development process, the surface of the photosensitive drum 18 is uniformly charged by the voltage applied to, and rotation of, the charging roller 20. When the charged part of the photosensitive drum 18 is rotated under the LED head 19, the controller operates through an exposure control part to form an electrostatic latent image on the photosensitive drum 18 through emissions from the LED head 19 based on image data of the image to be printed. When the part on the photosensitive drum 18 on which the electrostatic latent image is formed abuts the development roller 15, the toner on the development roller 15 that has been thinned by the development blade 17 moves onto the photosensitive drum 18 due to a potential difference between the electrostatic latent image on the photosensitive drum 18 and the development roller, 15. A toner image is thereby formed.

In the transfer process, the toner image on the photosensitive drum 18 is transferred on the sheet P when the sheet P passes between the photosensitive drum 18 and the transfer roller 6. In the fusion process, toner image is fixed on the sheet P by the heat from the heat roller 7 of the fuser 9 and pressure from the backup roller 8.

After the transfer process, a part of the toner that was not transferred from, and remains on, the photosensitive drum 18 is removed by the cleaning roller 21. After the print operation, the controller collects the toner on the cleaning roller 21 for further transfer to the development roller 15 via the photosensitive drum 18 based on a predetermined sequence. The toner transferred to the development roller 15 is recycled.

For testing purposes, a plurality of toner cartridges 23 were produced as samples and were variously installed in a developing device 5 of the printer 1, the developing device 5 performing the above-described print operation. Continuous print tests were conducted by continuously printing an image at 25% density on an A4-size sheet (the printable area of the A4-size paper is defined as 100% and the image is printed in ¼ areas of the A4-size sheet) under normal temperature and humidity. The printing was continuous until thin spots were observed in the printed image.

The continuous print tests were conducted by respectively installing, in the developing device 5 of the printer 1, twenty eight (28) sample toner cartridges 23 including four (4) types of toner cartridges 23 (TC-α, TC-β, TC-γ, TC-δ), with different shapes in the ejection opening 35, in which toners A-C and D-F that were produced using different production methods, the toner types varying in degree of agglomeration μ (unit: %), compact densities d (unit: g/mm$^3$) and different fill amount M (unit: g).

Figure 5B:
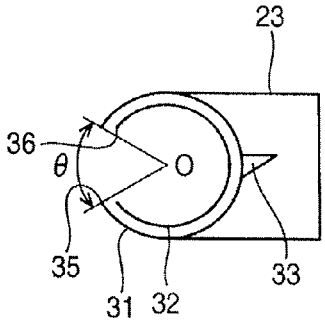

Referring now to FIG. 5A, the ejection opening 35 of the toner cartridge 23 used during testing are formed with a length L1 (unit: mm) in the longitudinal direction and a length L2 (unit: mm) in the lateral direction of the ejection opening 35 as shown in FIG. 5A. In the following explanation, the multiplication of the lengths L1 and L2 defines an area S=(L1×L2) of the ejection opening 35 (unit: mm$^2$). As shown in FIG. 5B, a setting angle θ (unit: degree) is formed by two lines connecting the axial center O of the outer case 31 and respective end points of a side of the ejection opening 35 in the lateral direction.

Thus, FIG. 5A is a bottom view of the toner cartridge 23 as seen from inside the main body 5*a*, and FIG. 5B is a cross-sectional view illustrating a cross-section of the outer case 31 of the toner cartridge 23 in a direction orthogonal with the axial direction of the outer case 31 seen from the right hand side of FIG. 5A.

Of the samples, the ejection opening 35 of TC-α had L1=150 mm, L2=4 mm, and setting angle θ=13.1°. The ejection opening 35 of TC-β had L1=150 mm, L2=8 mm, and setting angle θ=26.5°. The ejection opening 35 of TC-γ had L1=190 mm, L2=11 mm, and setting angle θ=36.7°. The ejection opening 35 of TC-δ had L1=180 mm, L2=21 mm, and setting angle θ=72.0°.

It is not preferable to configure the setting angle θ larger than the setting angle θ of TC-δ (72.0°) for the reason that such a configuration of the toner cartridge 23 would cause toner leakage during transportation due to insufficient strength, and the like. In addition, the toners A-C filled in the sample toner cartridges 23 were produced by a polymerization method, and the toners D-F were produced by a crushing method.

Production of the toners using the polymerization method is described below. Initial particles were formed by obtaining a styrene-acrylic copolymer resin from styrene, acrylic acid and methyl methacrylate in a water solvent. In addition, black carbon was used as the colorant. Moreover, for wax, stearyl stearate was used as high-grade fatty acid ester. These were mixed and aggregated to obtain a base toner.

After adding 0.7 parts by weight of hydrophobic silica fine powder "R-972" (by Nippon Aerosil Co., Ltd.) and 1.7 parts by weight of hydrophobic silica fine powder "RY-50" (by Nippon Aerosil Co., Ltd.) to 100 parts by weight of the base toner and mixing the mixture using a Henschel mixer (by Mitsui Mining & Smelting Co., Ltd.), the mixture was sifted to obtain toner A. In addition, toner B was produced by changing the amount of powders. Furthermore, toner C was obtained by adding positively charged fine grain melamine that has effects for blushing and thin spots in the printing.

The degree of agglomeration μ of the toners A-C as produced by the above method and was measured using a multitester (MT-1001 by Seishin Enterprise Co., Ltd.). That is, screens with openings of 250 μm, 150 μm and 75 μm, respectively, were set, and 2.0 g (total weight Wt of the toner for measuring the degree of agglomeration) of new toner was gently placed on the screen with the openings of 250 μm, Then, the screens were vibrated for 95 seconds at amplitude of 1.0 mm. The weight of the toner on each screen was measured, and the degree of agglomeration μ of the toner were calculated using the below equation.

Degree of agglomeration μ={[(weight of the toner on the screen with the opening of 250 μm)/Wt]×100}+{[(weight of the toner on the screen with the opening of 150 μm)/Wt]×(3/5)×100}+{[(weight of the toner on the screen with the opening of 75 μm)/Wt]×(1/5)×100} (unit: %)

The measurement similar to the above was repeated three times, and the average value was determined as the degree of agglomeration μ. As a result of the measurements, the degree of agglomeration μ of the toner A was 16.7%, the degree of agglomeration μ of the toner B was 33.2%, and the degree of agglomeration μ of the toner C was 51.7%.

It is possible that a degree of agglomeration μ could be reduced to less than the degree of agglomeration μ of the toner A. However, it highly probable that a problem in print quality would occur. For example, frictional electrification would not be sufficiently performed, and so-called blushing would occur. Therefore, such a degree of agglomeration μ was not obtained and tested. Moreover, it should be noted that the degree of agglomeration μ tends to increase (by approximately 40% or greater) when melamine is added.

In addition, the compact density d of the toners A-C was measured using the same multi-tester. That is, a 100 $mm^3$ graduated cylinder was placed on a tapping table of the multi-tester. Then, the toner was inserted in the graduated cylinder while passing through the 250 μm screen so that the amount of toner becomes the volume of 100 $mm^3$. From this state, after the tapping table was tapped for 2,000 times with a tapping distance of 18 mm, the compact density d was determined from the volume and mass of the toner.

As a result of the measurement, the compact density d of the toners A-C was 0.651 $g/mm^3$, 0.640 $g/mm^3$, and 0.636 $g/mm^3$, respectively.

With respect to the fine powder (referred to as an external additive) to be mixed with the base toner, silica, alumina, titanic oxide, barium titanate, magnesium titanate, calcium titanate, strontium titanate, zinc oxide, silica sand, clay, mica, wollastonite, diatomite, chrome oxide, cerium oxide, colcothar, antimony trioxide, magnesium oxide, zirconium oxide, barium sulfate, barium carbonate, calcium carbonate, silicon carbide, silicon nitride, or the like may be used.

Further, the silica fine powder is a fine powder that includes a Si—O—Si biding and may be produced by a dry or wet method. Instead of anhydrous silica dioxide, aluminum silicate, sodium silicate, potassium silicate, magnesium silicate, zinc silicate or the like may be used. Alternatively, a silica fine powder may be used, in which a surface treatment has been performed using a silane coupling agent, a titanium coupling agent, silicon oil, silicon oil having amine on the lateral chain thereof, or the like.

Samples 1-14 were made by combining the produced toners A-C with the above-described TC-α to TC-δ and changing the sill amount M.

That is, for sample 1, 80 g of the toner A was filled in the TC-α. For sample 2, 80 g of the toner A was filled in the TC-β. For sample 3, 80 g of the toner B was filled in the TC-β. For sample 4, 80 g of the toner C was filled in the TC-β. For sample 5, 80 g of the toner A was filled in the TC-γ. For sample 6, 160 g of the toner A was filled in the TC-γ. For sample 7, 245 g of the toner A was filled in the TC-γ. For sample 8, 80 g of the toner B was filled in the TC-γ. For sample 9, 160 g of the toner B was filled in the TC-γ. For sample 10, 80 g of the toner C was filled in the TC-γ. For sample 11, 160 g of the toner C was filled in the TC-γ. For sample 12, 245 g of the toner A was filled in the TC-δ. For sample 13, 160 g of the toner B was filled in the TC-δ. For sample 14, 160 g of the toner C was filled in the TC-δ.

Moreover, for the production of the toner by the crushing method, after sufficiently agitating and mixing a composition mixture made from 100 parts by weight of a polyester resin (number average molecular weight: 3700; glass transition point Tg=62° C.) as a binder resin, 1 part by weight of salicylic acid complex as a charging control agent, 3 parts by weight of carbon black as a colorant, and 10 parts by weight of a release agent (Tg=100° C.) in a blending machine (a Henschel mixer by Mitsui Miike Chemical Engineering Machinery, Co., Ltd.), the obtained mixture was heated, melted and kneaded for three hours at a temperature of 100° C. by an open roll continuous kneading machine (Kneadex by Mitsui Mining Co., Ltd.) and was cooled down to a room temperature. Then, the obtained kneaded mixture was crushed using a collision crusher (Dispersion Separator by Nippon Pneumatic Mfg Co., Ltd.) that uses jet stream. Thereafter, the crushed mixture was classed by a wind rotor rotation type dry airflow classifier (Micron Separator by Hosokawa Micron Corp.), using centrifugal force, to obtain the base toner. After adding 1.0 parts by weight of hydrophobic silica fine powder "R-972" (by Nippon Aerosil Co., Ltd.), 1.5 parts by weight of hydrophobic silica fine powder "RY-50" (by Nippon Aerosil Co., Ltd.) and melamine, which includes positively charged fine grains, to 100 parts by weight of the base toner and mixing the mixture using a Henschel mixer (by Mitsui Mining & Smelting Co., Ltd.), the mixture was sifted to obtain the toner D. Moreover, the toners E and F were obtained by changing the amount of melamine added.

The degree of agglomeration μ and the compact density d of the produced toners D-F were measured by the same method as the above-described method. The degree of agglomeration μ and the compact density d of the toner D were 22.4% and 0.553 $g/mm^3$, respectively. The degree of agglomeration μ and the compact density d of the toner E were 38.0% and 0.520 $g/mm^3$, respectively. The degree of agglomeration μ and the compact density d of the toner F were 51.5% and 0.541 $g/mm^3$, respectively.

Samples 15-28 were made by combining the produced toners D-F with the TC-α to TC-δ and changing the fill amount M of the toners.

That is, for sample 15, 78 g of the toner D was filled in the TC-α. For sample 16, 78 g of the toner D was filled in the TC-β. For sample 17, 78 g of the toner E was filled in the TC-β. For sample 18, 78 g of the toner F was filled in the TC-β. For sample 19, 78 g of the toner D was filled in the TC-γ. For sample 20, 170 g of the toner D was filled in the TC-γ. For sample 21, 240 g of the toner D was filled in the TC-γ. For sample 22, 78 g of the toner E was filled in the TC-γ. For sample 23, 170 g of the toner E was filled in the TC-γ. For sample 24, 78 g of the toner F was filled in the TC-γ. For sample 25, 170 g of the toner F was filled in the TC-γ. For sample 26, 240 g of the toner D was filled in the TC-δ. For sample 27, 170 g of the toner F was filled in the TC-δ. For sample 28, 240 g of the toner F was filled in the TC-δ.

Using the samples produced as described above, the above-described continuous print tests were conducted. In evaluating the continuous print tests, when an amount of toner remaining in the toner cartridge 23 (the toner remaining amount) when thin spots occurred was less than 10 g (that is, the toner remaining amount<10 g), the sample is indicated with "○," and when am mount of toner remaining in the toner cartridge 23 when thin spots occurred, was equal to or more than 10 g (that is, the toner remaining amount≥10 g), the sample is indicated with "×."

The reason for setting the reference value at 10 g for the evaluation of the toner remaining amount is because the total amount of the toner attached as a thin layer to the inner wall of the toner cartridge 23 due to the electrostatic force or the like was approximately 10 g. In other words, it is considered realistically impossible to use up all the toner completely until the toner remaining amount becomes zero.

Of the continuous print tests, the evaluation results based on the samples using the toners A-C produced by the polymerization method and various conditions of the respective toners and toner cartridge 23 used are shown in FIG. 6. In addition, the evaluation results based on the samples using the toners D-F produced by the crushing method and various conditions of the respective toners and toner cartridge 23 used are shown in FIG. 7.

As shown in FIG. 6, the toner remaining amount was equal to or more than 10 g for sample 1. The toner remaining amount was less than 10 g for sample 2. The toner remaining amount was equal to or more than 10 g for samples 3 and 4. The toner remaining amount was less than 10 g for samples 5 and 6. The toner remaining amount was equal to or more than 10 g for sample 7. The toner remaining amount was less than 10 g for sample 8. The toner remaining amount was equal to or more than 10 g for sample 9. The toner remaining amount was less than 10 g for sample 10. The toner remaining amount was equal to or more than 10 g for sample 11. The toner remaining amount was less than 10 g for samples 12 and 13. The toner remaining amount was equal to or more than 10 g for sample 14.

In addition, as shown in FIG. 7, the toner remaining amount was equal to or more than 10 g for sample 15. The toner remaining amount was less than 10 g for sample 16. The toner remaining amount was equal to or more than 10 g for samples 17 and 18. The toner remaining amount was less than 10 g for samples 19 and 20. The toner remaining amount was equal to or more than 10 g for sample 21. The toner remaining amount was less than 10 g for sample 22. The toner remaining amount was equal to or more than 10 g for sample 23. The toner remaining amount was less than 10 g for sample 24. The toner remaining amount was equal to or more than 10 g for sample 25. The toner remaining amount was less than 10 g for samples 26 and 27. The toner remaining amount was equal to or more than 10 g for sample 28.

From these evaluation results, the following perspective is made to obtain an index for a case where the toner remaining amount at the time when thin spots occur is less than 10 g. That is, the parameters considered as relating to toner remaining amount are the degree of agglomeration μ and compact density d of the toner, the area S of the ejection opening 35 of the toner cartridge 23, and the fill amount M of the toner in the toner cartridge 23.

The relationship between the ease with which the toner falls from the toner cartridge 23, due to the weight of the toner, and each parameter are now considered. The larger the degree of agglomeration μ of the toner, the poorer the flowability. Therefore, the degree of agglomeration μ is inversely proportional to the ease with which the toner falls due to the weight of the toner. A larger compact density d in the toner results in easy clogging. That is to say, the toner is easily compacter. Therefore, the compact density d is inversely proportional to the ease with which the toner falls due to the weight of the toner.

Intuitively, a larger area S of the ejection opening 35 of the toner cartridge 23 means a wider opening for the toner to fall through. Therefore, the area S is proportional to the ease in falling due to the weight of the toner. A larger fill amount M of toner with respect to the toner cartridge 23 results in easy clogging when the area S of the ejection opening 35 is constant. Therefore, the fill amount M of the toner is inversely proportional to the ease with which the toner falls due to the weight of the toner.

A toner ejection index Th is defined by Th=S/μdM (unit: $\mu m^5/g^2\%$) where the numerator is the factor in the relationship proportional to the ease with which toner falls due to the weight of the toner, and the denominator is the factors in an inverse proportional relationship. Calculation results of the toner ejection index Th=S/μdM for the samples 1-14 and the samples 15-28 are shown in FIGS. 6 and 7, respectively.

Figure 8:
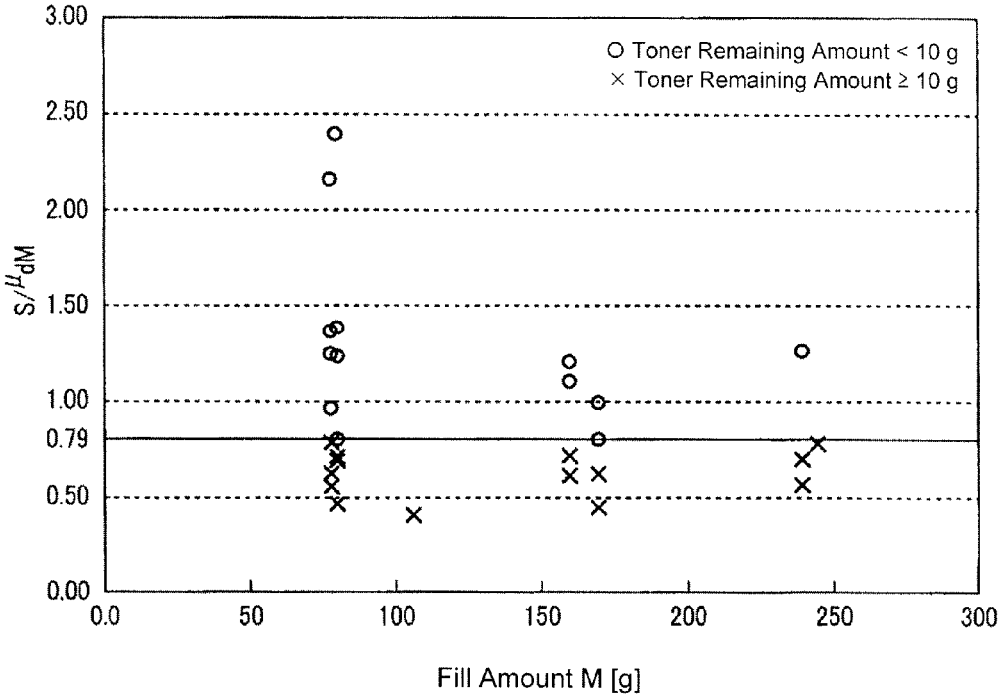
FIG. 8 is a graph illustrating the evaluation results of a continuous print test using a developing device according to the exemplary embodiment.

Moreover, a graph is shown in FIG. 8, in which the evaluation results of the samples 1-28, that is, the results of evaluation using the toners produced by the different production methods, are plotted with the fill amount M of the toner on the horizontal axis and the toner ejection index Th=S/μdM on the vertical axis. Each plotted point in FIG. 8 indicates a symbol of the evaluation result.

As is clear from FIG. 8, the samples wherein the toner remaining amount at the time when thin spots occur is less than 10 g (that is the samples for which the evaluation results are shown by a "○") are indicated by a toner ejection index Th that is equal to or more than 0.79. Therefore, it is understood that to supply toner to the developing device smoothly and to maintain the toner remaining amount at the time when thin spots occur at less than 10 g, the toner ejection index Th=S/μdM is configured to be equal to or more than 0.79, regardless of the production methods of the toner.

Further, as clear from FIGS. 6 and 7, it is understood that, when the setting angle θ is less than 26.5°, the toner remaining amount at the time when thin spots occur is always equal to or more than 10 g. Please see FIGS. 6 and 7 where the toner remaining amount evaluation result is "×", such as in samples 1 and 15. Therefore, to supply the toner to the developing device smoothly and to prevent the toner from leaking during transportation due to insufficient strength, it is preferable that the setting angle θ is in a range equal to or more than 26.5° and equal to or less than 72.0°.

As described above, by designing the toner and the toner cartridge 23 such that, using the area S of the ejection opening 35 of the outer case 31, the degree of agglomeration μ, the compact density d, and the fill amount M of the toner, wherein the toner ejection index Th=S/μdM is equal to or more than 0.79, the toner may be smoothly supplied from the toner cartridge 23 to the developing device 5 with a simple structure, even if an agitator mechanism is not provided in the toner cartridge 23 and regardless of the production method of the toner. In addition, the toner remaining amount at the time when thin spots occur is maintained at less than 10 g. As a result, and because an agitator member need not be provided in the toner cartridge, the drive mechanism and the drive source for rotating the agitator member also need not be provided. Therefore, the structure of the developing device, and that of the corresponding printer, is prevented from becoming too complicated.

Furthermore, if the agitator mechanism is not provided in the toner cartridge, the external additive on the toner surface is prevented from being detached from the toner by physical force from the agitator mechanism and from being buried in the toner, causing degradation of print quality over time.

As described above, in the present embodiment, by configuring the value calculated by S/μdM to be equal to or more than 0.79 where μ is the degree of agglomeration of the toner, d is the compact density, M is the fill amount of the toner and S is the area of the ejection opening of the outer case for the toner cartridge, the toner is smoothly supplied from the toner cartridge to the developing device with a simple structure, and the toner remaining amount at the time when thin spots occur can be decreased, regardless of the production method of the toner.

It should be noted that the above-described embodiment is described with the toner cartridge 23 being used in a printer as an example. However, the device to which the toner cartridge can be provided is not limited to the printer, but may also be a facsimile machine, a photocopy machine, or any like device that uses the electrographic method.

Moreover, types and amount of the primary materials (e.g., binder resin, charging control agent and colorant) of the base toner, types and amount of fine powder (e.g., silica and melamine) mixed with the base toner, the area of the ejection opening 35 of the toner cartridge and the like in the above-described embodiment are merely examples. Even if other conditions are used, effects thereof are not affected if the toner ejection index Th=S/μdM is equal to or more than 0.79.

What is claimed is:

1. A developer container, comprising:

an outer case;

an ejection opening that is rectangular and formed on the outer case and extends longitudinally along an axial direction of the outer case, and from which a developer is ejected by a weight of the developer, wherein a toner ejection index that is calculated from $S/\mu dM$ is equal to or more than 0.79, where $\mu$ is a degree of agglomeration of the developer, d is a compact density, M is a fill amount of the developer and S is the area of the ejection opening.

2. The developer container of claim 1, wherein the outer case includes a curvature region, and the ejection opening is formed in the curvature region.

3. The developer container of claim 1, wherein the curvature region is an arc surface that is formed about an axial center.

4. The developer container of claim 3, wherein in a cross-section of the outer case in a direction perpendicular to the axial center, a setting angle $\theta$ formed by two lines connecting the axial center and respective end points of a side of the ejection opening in a lateral direction is equal to or more than 26.5° and equal to or less than 72.0°.

5. The developer container of claim 3, further comprising:

a shutter member that opens and closes the ejection opening.

6. The developer container of claim 5, wherein the shutter member has a cylindrical shape and includes a rotational center on the axial center.

7. The developer container of claim 5, wherein the shutter member includes a shutter opening.

8. The developer container of claim 7, wherein the shutter member is rotatably supported inside the outer case, such that when the shutter is rotated to a point where the shutter opening is aligned over the ejection opening, the ejection opening is open.

9. The developer container of claim 1, wherein the developer container contains toner therein.

10. A developing device, comprising:

the developer container of claim 1; and a developing device main body to which the developer is supplied from the developer container.

11. The developing device of claim 10, wherein the developer container is attached to an upper part of the developing device main body.

12. The developing device of claim 10, wherein the developing device main body includes a developer container installation part, and the developer container is detachable from the developer container installation part.

13. An image forming device, comprising:

the developing device of claim 10.

14. An agitation member-free developer container, comprising:

a rectangular parallelepiped body with a semicircular arc part;

an outer case provided on the semicircular arc part;

a rectangular ejection opening provided on the semicircular arc part and the outer case, the ejection opening having an area S; and a rotatable shutter member including a shutter opening, the shutter opening having a size larger than the area S, wherein the outer case and the shutter member are provided concentrically with semicircular arc part and each other, and the developer container is capable of ejecting developer through the shutter member and ejection opening without an agitation member when a condition $S/\mu dM \geq 0.79$ is satisfied, where $\mu$ is a degree of agglomeration of the developer, d is a compact density, and M is a fill amount of the developer.

15. The agitation member-free developer device of claim 14, wherein the shutter member is rotatably supported inside the outer case, and the shutter member is rotated to open and close the ejection opening.

16. The agitation member-free developer device of claim 15, wherein the ejection opening is open when at least a portion of the shutter opening is aligned over the ejection opening.

* * * * *